US007015890B2

(12) United States Patent
Moon

(10) Patent No.: US 7,015,890 B2
(45) Date of Patent: Mar. 21, 2006

(54) LIQUID CRYSTAL DISPLAY APPARATUS AND METHOD FOR DRIVING THE SAME

(75) Inventor: Seung-Hwan Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 660 days.

(21) Appl. No.: 10/107,716

(22) Filed: Mar. 27, 2002

(65) Prior Publication Data

US 2003/0058204 A1 Mar. 27, 2003

(30) Foreign Application Priority Data

Sep. 25, 2001 (KR) ..... 2001-59319

(51) Int. Cl.
*G09G 3/36* (2006.01)

(52) U.S. Cl. ..... 345/100; 345/98

(58) Field of Classification Search ..... 345/87–104, 345/208–213

See application file for complete search history.

(56) References Cited

U.S. PATENT DOCUMENTS 4,386,352 A * 5/1983 Nonomura et al. ..... 345/92
4,393,380 A * 7/1983 Hosokawa et al. ..... 345/90
5,398,043 A * 3/1995 Takeda et al. ..... 345/94
5,434,599 A * 7/1995 Hirai et al. ..... 345/100
6,222,516 B1 * 4/2001 Oda et al. ..... 345/94
2002/0089477 A1 * 7/2002 Kanbe et al. ..... 345/87

* cited by examiner

*Primary Examiner*—Xiao Wu
(74) *Attorney, Agent, or Firm*—F.Chau & Associates, LLC

(57) ABSTRACT

A liquid crystal display is provided. The display includes: a data driver for outputting image signals; a gate driver for sequentially outputting scanning signals; a liquid crystal panel including a switching element for controlling the image signal in response to the scanning signal, a liquid crystal capacitor driven by a voltage difference between the image signal and a common electrode voltage, and a storage capacitor for accumulating the charge of image signal when the switching element is on, and applying the accumulated image signal to the liquid crystal capacitor when the switching element is turned off; a distortion detector for detecting the common electrode voltage applied to the liquid crystal capacitor and outputting a common electrode distortion voltage; and an offset voltage generator for outputting an offset voltage to increase a rate of charge of the storage capacitor based on the common electrode distortion voltage.

13 Claims, 5 Drawing Sheets

LIQUID CRYSTAL DISPLAY APPARATUS AND METHOD FOR DRIVING THE SAME

BACKGROUND OF THE INVENTION (a) Field of the Invention

The present invention relates to a liquid crystal display apparatus and a method for driving the same, and more specifically, an apparatus and a method for driving the liquid crystal display with reduced crosstalk and distortion.

(b) Description of the Related Art

Liquid crystal display is widely used for flat panel display devices in many applications. Generally, the liquid crystal display has two substrates with electrodes, and a liquid crystal layer interposed between the two substrates. Each of the two substrates is sealed by a sealer while being spaced apart from each other by spacers. A voltage is applied to the electrodes so that the liquid crystal molecules in the liquid crystal layer are re-oriented to thereby control an amount of light transmission through the liquid crystal layer. Thin film transistors are provided at one of the substrates to control the signals transmitted to the electrodes.

It is known that the operations of a liquid crystal display depend at least in part on the turning on and off of electric fields applied to liquid crystals. Crosstalk is the interfering effect from signals or noise generated by the turning on and off of the electric field or transmitted signals.

In a liquid crystal display, crosstalk is also generated from the charging and discharging of pixels, which is proportional to the difference between an input gray voltage at a data line and a common electrode voltage. The distortion of the common electrode voltage may prevent pixels from reducing a desired gray voltage.

The distortion of the common electrode voltage is usually caused by a parasitic capacitance between a data line (horizontal resolution ×3) in the liquid crystal display and a common electrode in the upper liquid crystal display panel. More specifically, the distortion typically occurs when the gray voltage at the data line rises or falls and the common electrode voltage is coupled to the rising or falling voltage. Uncontrolled crosstalk or distortion adversely affects the picture quality of the liquid crystal display. FIG. 1 shows a waveform of a signal having crosstalk. Referring to FIG. 1, the pixel charging state is determined in proportion to the area related to the difference between the gray voltage level and the common electrode voltage level, with area A having larger amplitude of the gray voltage waveform as compared to area B. This difference in areas A and B causes variations in the charging rate, such as in the intermediate gray voltage. Accordingly, a need exists for a liquid crystal display having an anti-crosstalk function to thereby secure a constant charging rate of a pixel of the liquid crystal display.

SUMMARY OF THE INVENTION

A liquid crystal display is provided, which includes: a data driver for outputting an image signal; a gate driver for sequentially outputting a scanning signal; a liquid crystal display panel including a plurality of pixels for displaying an image, the plurality of pixel having a switching element for controlling the image signal in response to the scanning signal, a liquid crystal capacitor driven by a voltage difference between the image signal received at one terminal thereof and a common electrode voltage received at another terminal thereof, and a storage capacitor for accumulating the charge of image signal received at the one terminal thereof when the switching element is turned on, and applying the accumulated image signal to the liquid crystal capacitor via the one terminal thereof when the switching element is turned off; a distortion detector for detecting the common electrode voltage applied to the other terminal of the liquid crystal capacitor and outputting a common electrode distortion voltage; and an offset voltage generator for outputting an offset voltage to change a rate of charge of the storage capacitor based on the common electrode distortion voltage.

According to an embodiment of the present invention, the distortion detector includes a detection resistor for detecting the common electrode voltage and outputting the common electrode distortion voltage. The distortion detector detects a potential difference between both terminals of the detection resistor. The distortion detector detects a potential difference between both terminals of an internal resistor of the liquid crystal panel applied to the common electrode voltage and outputs the common electrode distortion voltage. The offset voltage generator receives the common electrode voltage at a non-inverting terminal thereof and the common electrode distortion voltage at an inverting terminal thereof, and outputs the offset voltage at an output terminal thereof.

According to an embodiment of the present invention, the offset voltage generator includes: an OP amplifier for receiving the common electrode voltage at a non-inverting terminal thereof and the common electrode distortion voltage at an inverting terminal thereof, and outputting an output voltage at an output terminal thereof to a DC component remover; and a DC component remover for removing a DC component of the output voltage and outputting an AC offset voltage. The offset voltage is in antiphase with respect to the common electrode distortion voltage. The offset voltage is generated at a capacitance ratio of the liquid crystal capacitor to the storage capacitor. The offset voltage generator for outputting the offset voltage increases a rate of charge of the storage capacitor based on the common electrode distortion voltage.

An apparatus for driving a liquid crystal display is provided, which includes a liquid crystal display panel that has a switching element formed in an area adjacent a gate line and a data line and is connected to the gate line and the data line, a liquid crystal capacitor for providing current to the switching element for controlling an image signal based on a pixel voltage in proportion to a common electrode voltage and a voltage potential of the data line, and a storage capacitor for accumulating the data voltage when the switching element is turned on, and applying the accumulated data voltage to the liquid crystal capacitor when the switching element is turned off. The apparatus includes: a distortion detector for detecting a distortion of the common electrode voltage applied to the liquid crystal capacitor and outputting a common electrode distortion voltage to the offset voltage generator; and an offset voltage generator for increasing a rate of charge of the storage capacitor based on the common electrode distortion voltage and outputting an offset voltage for overcharging the storage capacitor.

A method for driving a liquid crystal display is also provided, which includes a switching element connected to a gate line and a data line, a liquid crystal capacitor passing a light based on a pixel voltage in proportion to a common electrode voltage and a data voltage according to a turn-on operation of the switching element, and a storage capacitor having one terminal thereof connected to one terminal of the liquid crystal capacitor for accumulating the data voltage when the switching element is turned on, and which applies the accumulated data voltage to the liquid crystal capacitor when the switching element is turned off. The method includes the steps of: applying the data voltage to the data line; applying a scanning signal to the gate line for accumulating the data voltage applied to the data line via the terminals of the liquid crystal capacitor and the storage capacitor; applying the common electrode voltage to another terminal of the liquid crystal capacitor; detecting the common electrode voltage and outputting a common electrode distortion voltage proportional to a distorted portion of the common electrode voltage; generating an offset voltage for offsetting the distortion of the common electrode distortion voltage; and applying the offset voltage to the terminal of the storage capacitor.

According to an embodiment of the present invention, the offset voltage is in antiphase with respect to the common electrode distortion voltage. The offset voltage is proportional to a capacitance ratio of the liquid crystal capacitor to the storage capacitor.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF PREFERRED EMBODIMENTS

Figure 1:
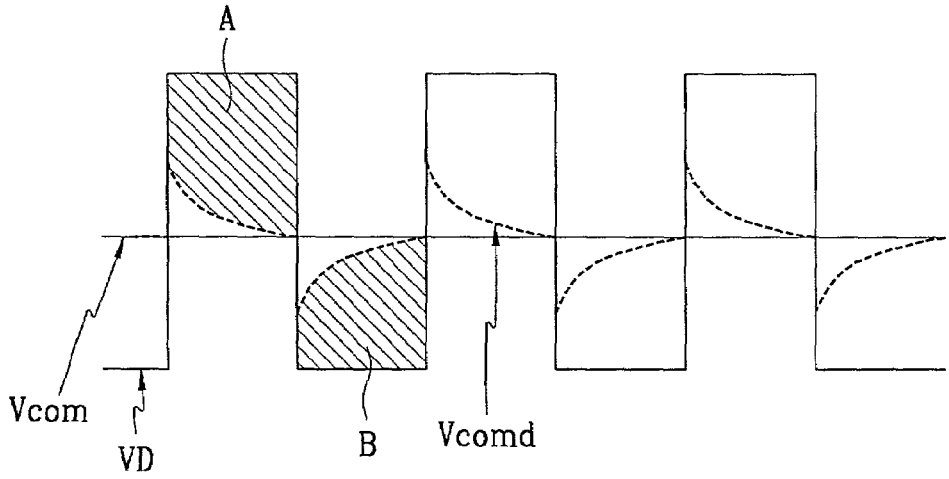
FIG. 1 is a waveform diagram of signals having crosstalk.

The features and advantages of the present invention will become more apparent from the detailed description of preferred embodiments with reference to the accompanying drawings, like reference numerals are used for description of like or equivalent parts or portions for simplicity of illustration and explanation.

Figure 2:
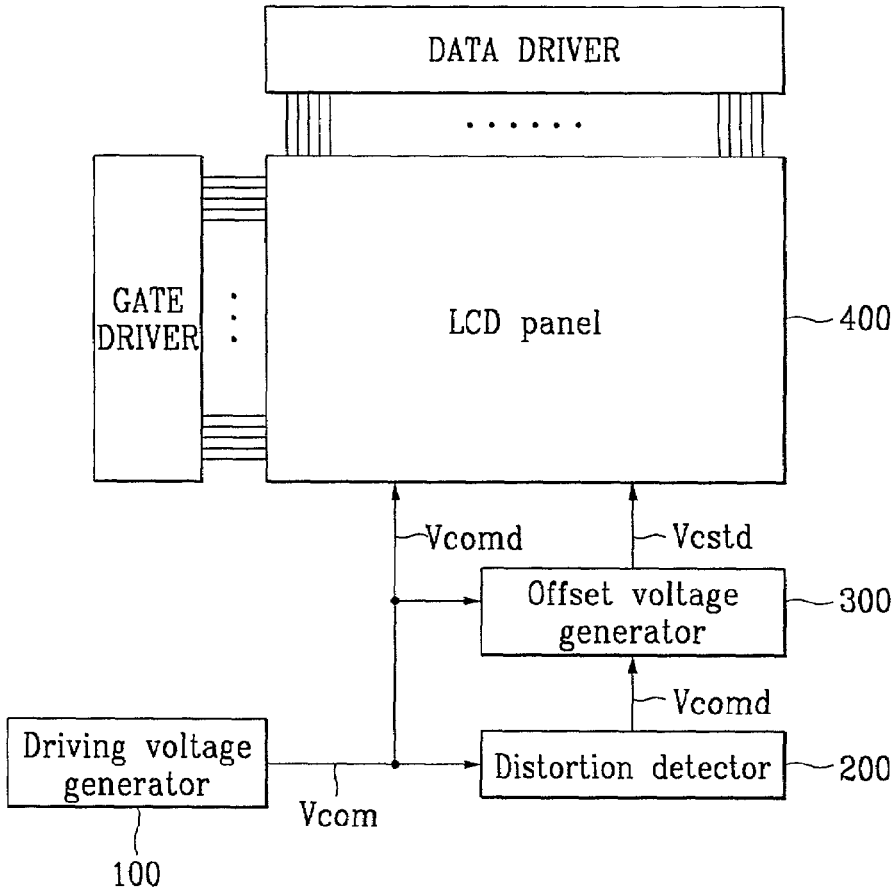
FIG. 2 illustrates a block diagram of a liquid crystal display according to an embodiment of the present invention.
Figure 3:
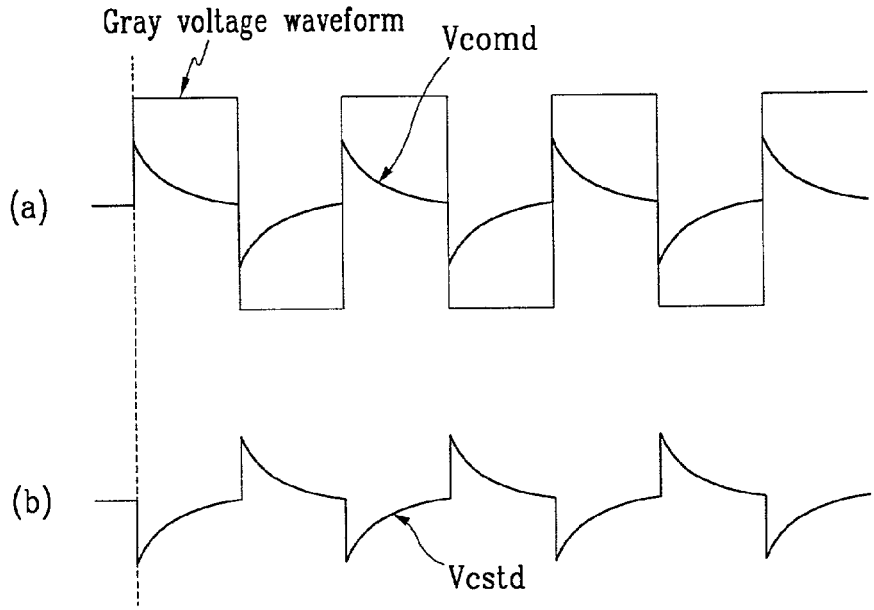
FIG. 3 illustrates waveform diagrams of a common electrode voltage generally applied and an offset voltage applied according to the present invention, respectively.

FIG. 2 illustrates a block diagram of a liquid crystal display according to an embodiment of the present invention. FIG. 3 illustrates waveform diagrams of a generally applied common electrode voltage and an offset voltage applied according to an embodiment of the present invention, respectively.

Referring to FIG. 2, the liquid crystal display according to an embodiment of the present invention includes a driving voltage generator 100, a distortion detector 200, an offset voltage generator 300, a liquid crystal display panel 400, a data driver for supplying an image signal to the liquid crystal display panel 400, and a gate driver for sequentially outputting a scanning signal to the liquid crystal display panel 400. The driving voltage generator 100 outputs a common electrode voltage $V_{com}$ as a reference of the data voltage difference to the distortion detector 200, the offset voltage generator 300, and the liquid crystal display panel 400. The distortion detector 200 receives the common electrode voltage $V_{com}$ from the driving voltage generator 100 to detect a distortion level of the common electrode voltage and sends a common electrode distortion voltage $V_{comd}$ to the offset voltage generator 300. The offset voltage generator 300 receives the common electrode voltage $V_{com}$ from the driving voltage generator 100 and the common electrode distortion voltage $V_{comd}$ from the distortion detector 200, and sends an offset voltage $V_{cstd}$ to the liquid crystal display panel 400. The liquid crystal display panel 400, including a plurality of pixels in a matrix format, receives the common electrode voltage $V_{com}$ from the driving voltage generator 100 and the offset voltage $V_{cstd}$ from the offset voltage generator 300. The common electrode distortion voltage $V_{comd}$ is applied to a common electrode line (not shown) of the liquid crystal display panel as shown in FIG. 3(*a*), the offset voltage $V_{cstd}$ is output to the common electrode line to compensate for a deficient charging rate of a liquid crystal capacitor (not shown in FIG. 3) as shown in FIG. 3(*b*), thereby reducing crosstalk.

Now, a detailed description will be given to the common electrode voltage $V_{com}$ generally applied to the liquid crystal display panel 400, and to the offset voltage $V_{cstd}$ applied to compensate for the distortion of the common electrode voltage $V_{com}$ according to the present invention.

Figure 4:
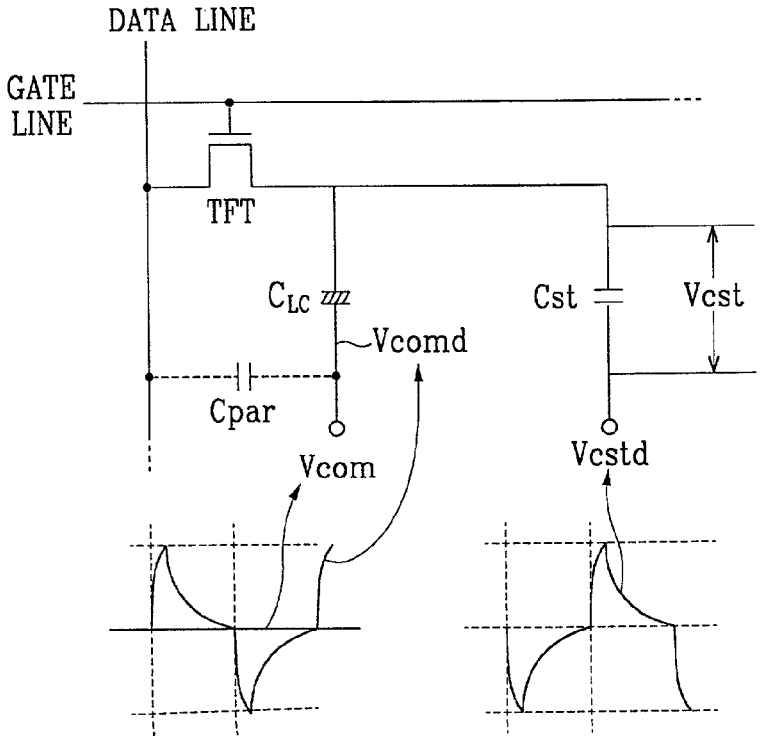
FIG. 4 is an equivalent circuit of a pixel in a liquid crystal display panel according to the present invention.

FIG. 4 illustrates the common electrode voltage and the offset voltage applied to a pixel of the liquid crystal panel according to an embodiment of the present invention. The illustrative pixel of the liquid crystal display panel 400 is formed in the area surrounded by a gate line and a data line, and includes a switching element TFT, a liquid crystal capacitor $C_{LC}$, and a storage capacitor $C_{st}$. The switching element TFT is connected to the gate line and the data line. The liquid crystal capacitor $C_{LC}$ charges and discharges a pixel voltage that is proportional to the common electrode voltage $V_{com}$ and the voltage from the data line to turn on/off the switching element TFT to thereby control the amount of light to output. The storage capacitor $C_{st}$ accumulates the data voltage when the switching element TFT is turned on, and applies the accumulated data voltage to the liquid crystal capacitor $C_{LC}$ when the switching element is turned off, thereby forming a picture.

It is preferred that the common electrode voltage $V_{com}$ is used as a reference of the positive data voltage and the negative data voltage applied to the liquid crystal capacitor $C_{LC}$. In practice, the common electrode voltage $V_{com}$ is distorted by a parasitic capacitor $C_{par}$ that exists between the data line and the liquid crystal capacitor $C_{LC}$. The parasitic capacitor $C_{par}$ causes a common electrode distortion voltage $V_{comd}$ to be applied to the liquid crystal capacitor $C_{LC}$. The existence of the common electrode distortion voltage $V_{comd}$ reduces the pixel charging rate in proportion to the difference between an input gray voltage at the data line and the common electrode voltage, and thereby causes crosstalk. According to an embodiment of the present invention, a predetermined offset voltage $V_{std}$ is supplied to the storage capacitor $C_{st}$ to compensate for the common electrode voltage distortion voltage $V_{comd}$. Preferably, the storage capacitor $C_{st}$ is overcharged to compensate for a deficient the charging rate of the liquid crystal capacitor $C_{LC}$ caused by the common electrode voltage distortion voltage $V_{comd}$. As a result, a difference in charging rate between the two capacitors $C_{LC}$ and $C_{st}$ for a pixel offsets the deficient charging rate of the liquid crystal capacitor $C_{LC}$. Preferably, the voltage applied to the data line which is a representation of gray and the resulting distortion level of the common electrode voltage $V_{com}$ are out-of-phase (antiphase). The combined voltage is applied to the storage capacitor $C_{st}$. The combined distortion voltage applied to the storage capacitor $C_{st}$ is dependent on the capacitance ratio of the liquid crystal capacitor $C_{LC}$ to the storage capacitor $C_{st}$. For example, when the capacitance ratio of the liquid crystal capacitor $C_{LC}$ to the storage capacitor $C_{st}$ is 1:1, an offset voltage $V_{cstd}$ having the same level as the common electrode distortion voltage $V_{comd}$ and being in antiphase with respect to the common electrode distortion voltage $V_{comd}$ is applied to the storage capacitor $C_{st}$. When the capacitance ratio of the liquid crystal capacitor $C_{LC}$ and the storage capacitor $C_{st}$ is 2:1, an offset voltage $V_{cstd}$ of 0.5 of the common electrode distortion voltage $V_{comd}$ and being in antiphase with respect to the common electrode distortion voltage $V_{comd}$ is applied to the storage capacitor $C_{st}$.

Now, the effect of the present invention thus obtained will be described in further detail.

Assuming an ideal state in which there is no distortion of the common electrode voltage $V_{com}$, the charge $Q_0$ charged in one pixel is given by Equation 1:

$$Q_0=C_{LC}\cdot(V_s-V_{com})+C_{st}\cdot(V_s-V_{cst}) \quad \text{[Equation 1]}$$

where $C_{LC}$ is the capacitance of the liquid crystal capacitor, $V_s$ is a data voltage applied to the data line during one hour (or one horizontal hour), $V_{com}$ is the common electrode voltage without distortion, $C_{st}$ is the capacitance of the storage capacitor, and $V_{cst}$ is a voltage applied to the storage capacitor $C_{st}$.

If distortion of the common electrode voltage occurs, the charge $Q_1$ accumulated in one pixel is given by Equation 2:

$$Q_1=C_{LC}\cdot(V_s-V_{comd})+C_{st}\cdot(V_s-V_{cst}) \quad \text{[Equation 2]}$$

where $V_{comd}$ is the common electrode distortion voltage during one hour (or one horizontal hour)

Accordingly, the difference between the charge $Q_0$ in the pixel without distortion and the charge $Q_1$ in the pixel with distortion can be calculated based on the Equations 1 and 2, and it is given by Equation 3:

$$Q_0-Q_1=C_{LC}\cdot(V_{comd}-V_{com}) \quad \text{[Equation 3]}$$

As shown in Equation 3, there occurs crosstalk in proportion to the difference in charging rates.

However, when the offset voltage $V_{cstd}$ is applied to the storage capacitor $C_{st}$ instead of the common electrode distortion voltage $V_{cst}$ according to the present invention, the charge $Q_2$ accumulated in one pixel is given by Equation 4:

$$Q_2=C_{LC}\cdot(V_s-V_{comd})+C_{st}\cdot(V_s-V_{cstd}) \quad \text{[Equation 4]}$$

where $$V_{cstd}=\frac{C_{LC}}{C_{st}}\cdot(V_{comd}-V_{com})+V_{cst}.$$

Accordingly, the difference between the charge $Q_0$ in the pixel without distortion and the charge $Q_2$ of the present invention is given by Equation 5:

$$Q_0-Q_2=C_{LC}\cdot(V_{comd}-V_{com})+C_{st}\cdot(V_{cstd}-V_{cst})=0 \quad \text{[Equation 5]}$$

As shown in Equation 5, the net charge is zero. Advantageously, the crosstalk which occurs in the common electrode voltage is offset and no distortion is seen at the liquid crystal capacitor $C_{st}$.

Figure 5A:
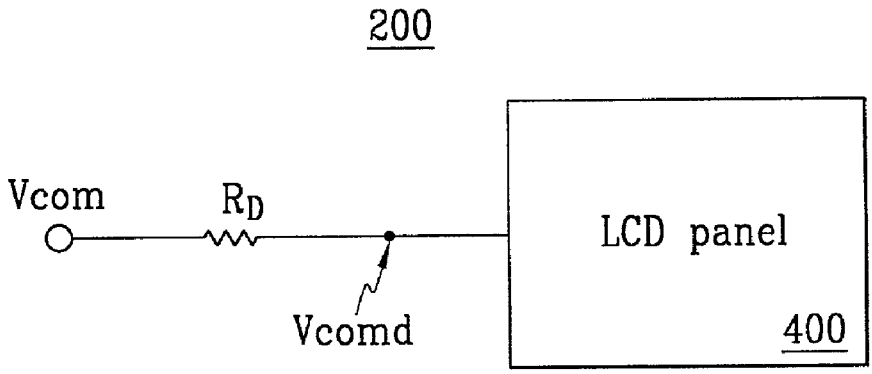
FIG. 5A illustrates a distortion detector usable in the system of FIG. 2.
Figure 5B:
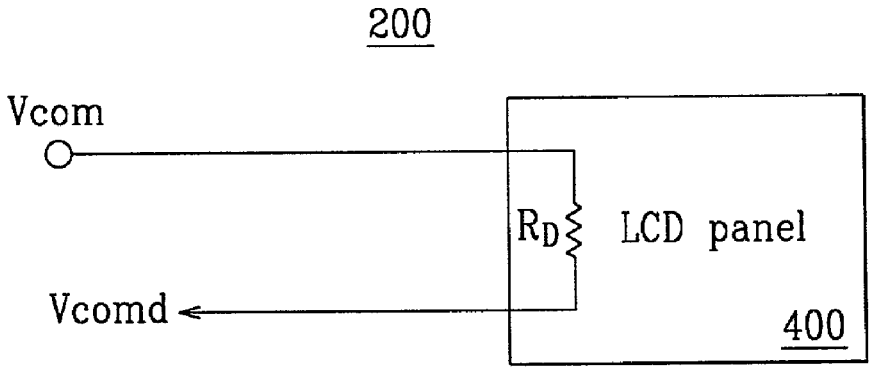
FIG. 5B is another distortion detector usable in the system of FIG. 2.

FIGS. 5A and 5B illustrate examples of the distortion detector according to a preferred embodiment of the present invention.

Referring to FIGS. 2 and 5A, before the common electrode voltage $V_{com}$ generated from the driving voltage generator 100 is applied to the liquid crystal display panel 400, a defined detection resistor $R_D$ is provided to detect a distortion level of the common electrode voltage $V_{com}$ with the potential difference between both terminals of the detection resistor $R_D$. And the defined detection resistor $R_D$ outputs the common electrode distortion voltage $V_{comd}$ to the offset voltage generator 300.

Referring to FIGS. 2 and 5B, after the common electrode voltage $V_{com}$ generated from the driving voltage generator 100 is applied to the liquid crystal display panel 400, a defined detection resistor $R_D$ is provided as an internal resistor of the liquid crystal display panel 400 to detect a distortion level of the common electrode voltage $V_{com}$ with the potential difference between both terminals of the detection resistor $R_D$. And a defined detection resistor $R_D$ outputs the common electrode distortion voltage $V_{comd}$ to the offset voltage generator 300.

Figure 6A:
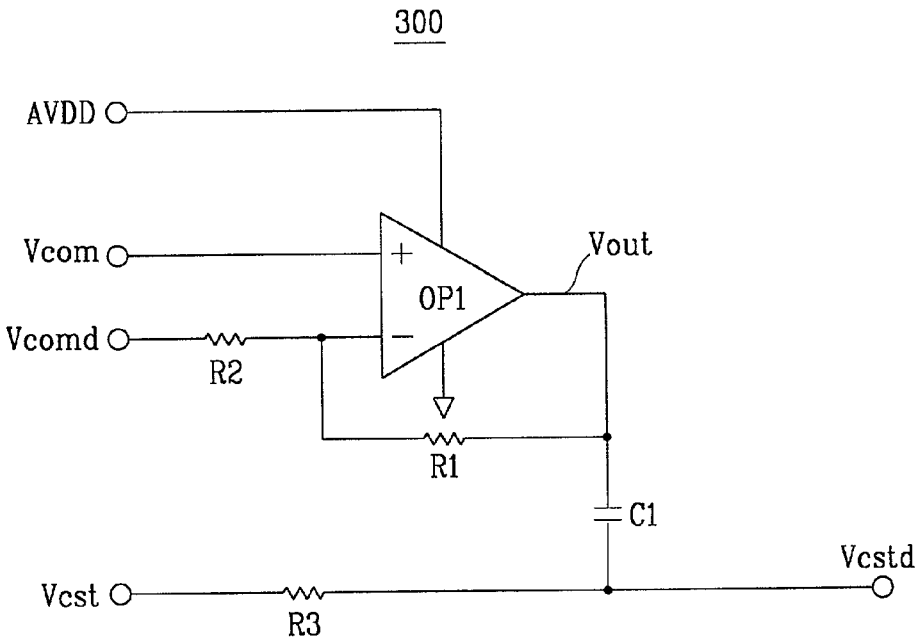
FIG. 6A illustrates an offset voltage generator shown in FIG. 2.

FIG. 6A illustrates an offset voltage generator 300 according to an embodiment of the present invention, which includes a first OP amplifier $OP_1$ driven by a power voltage $AV_{DD}$, first, second, and third resistors $R_1$, $R_2$, and $R_3$, and a first capacitor $C_1$. The first OP amplifier $OP_1$ preferably has a non-inverting input connected to the common electrode voltage $V_{com}$ and an inverting input connected to the first resistor $R_1$ and the second resistor $R_2$ connected in parallel with the first resistor $R_1$. The first resistor $R_1$ serves as a feedback resistor connected to an output of the first OP amplifier $OP_1$. The second resistor $R_2$ is connected to the common electrode distortion voltage $V_{comd}$.

In operation, the common electrode distortion voltage $V_{comd}$ is fed into the inverting input of the first OP amplifier OP, via the second resistor $R_2$, and an output voltage $V_{out}$ is output at the output of the first OP amplifier $OP_1$. A DC component of the output voltage $V_{out}$ is removed via the first capacitor $C_1$ and only an AC component of the output voltage $V_{out}$ is transferred, so that the offset voltage $V_{cstd}$ is output to the other terminal of the storage capacitor $C_{st}$ (in FIG. 4).

Next, the operation of the offset voltage generator shown in FIG. 6A will be described by way of the following equations.

The characteristic of the first OP amplifier OP1 shown in FIG. 6A can be defined as Equation 6:

$$V_{out}=-\left(\frac{R_1}{R_2}\right)\cdot V_{comd}+\left(1+\frac{R_1}{R_2}\right)\cdot V_{com} \quad \text{[Equation 6]}$$

The common electrode distortion voltage $V_{comd}$, which includes AC and DC components, can be defined as Equation 7:

$$V_{comd}=V_{comd}(AC)+V_{comd}(DC)=V_{comd}(AC)+V_{com} \quad \text{[Equation 7]}$$

Accordingly, Equation 6 can be rewritten based on Equation 7 and gives the output voltage $V_{out}$ from the first OP amplifier OP1 as Equation 8:

$$V_{out} = -\left(\frac{R_1}{R_2}\right)[V_{comd}(\mathrm{AC}) + V_{com}] + \left(1 + \frac{R_1}{R_2}\right)V_{com} = -\left(\frac{R_1}{R_2}\right)\cdot V_{comd}(\mathrm{AC}) + V_{com} \quad \text{[Equation 8]}$$

where the term $$\text{“}-\frac{R_1}{R_2}\cdot V_{comd}(\mathrm{AC})\text{”}$$

is the AC component and the term “$V_{com}$” is the DC component. But, since the output voltage $V_{out}$ passes through the first capacitor $C_1$, only the AC component, i.e., $$\text{“}-\frac{R_1}{R_2}\cdot V_{comd}(\mathrm{AC})\text{”}$$

is transferred to a level shift circuit (to the first capacitor $C_1$) as the charging voltage $V_{cst}$ of the storage capacitor caused by the first capacitor $C_1$ and the third resistor $R_3$. One skilled in the art can really appreciate that when applying the charging voltage $V_{cst}$ of the storage capacitor having the same level as the common electrode voltage $V_{com}$ to the storage capacitor $C_{st}$ (in FIG. 4), the output voltage $V_{out}$ can be directly applied to the other terminal of the storage capacitor $C_{st}$ (in FIG. 4) without filtering out the DC component.

Figure 6B:
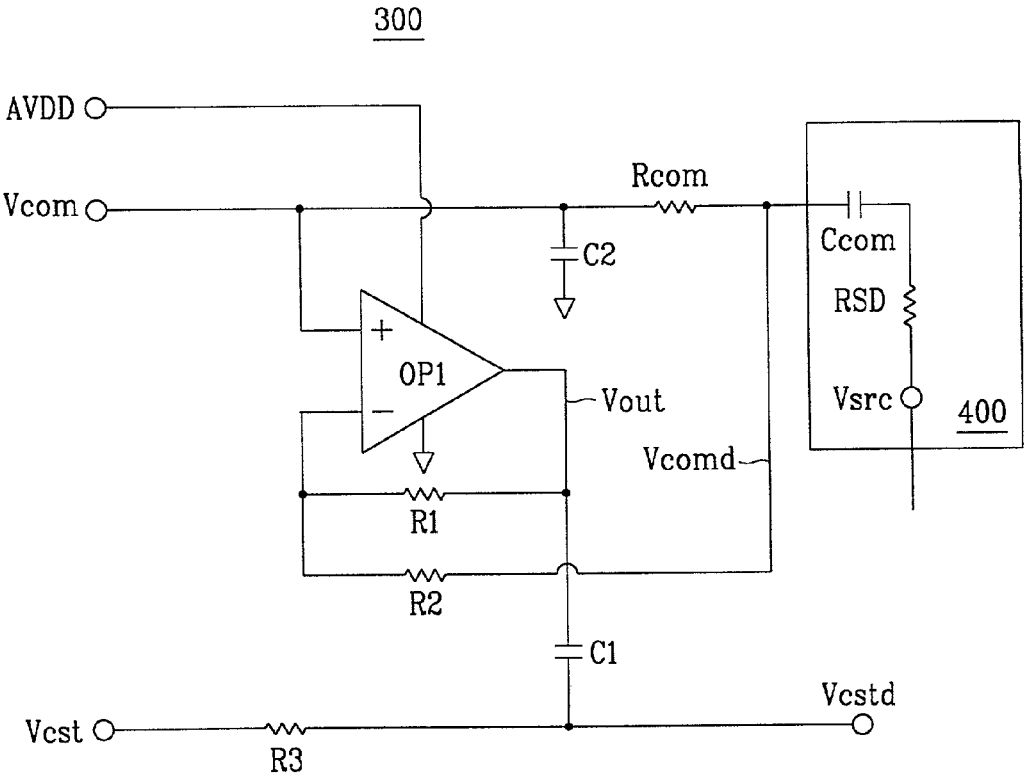
FIG. 6B is an equivalent circuit of the offset voltage generator in the liquid crystal display according to an embodiment of the present invention.

An equivalent circuit of the circuit of FIG. 6A is shown in FIG. 6B. Referring to FIG. 6B, a data voltage $V_{src}$ in the liquid crystal display panel 400 is an output voltage of the data driver (in FIG. 2) applied to the data line (in FIG. 4), and it is coupled to the common electrode voltage $V_{com}$ via a parasitic capacitor $C_{Com}$. This causes a distortion of the common electrode voltage $V_{com}$, which is the DC component, as the common electrode distortion voltage $V_{comd}$. The common electrode distortion voltage $V_{comd}$ is inverted and amplified at a predetermined ratio $R_1/R_2$ and only the distorted AC component is transferred to the charging voltage $V_{cst}$ of the storage capacitor via the first capacitor $C_1$. The role of the first capacitor $C_1$ is the same as FIG. 6A. In this way, the common electrode distortion voltage $V_{cst}$ is added to the offset voltage $V_{cstd}$ based on the charging voltage $V_{cst}$ of the storage capacitor to generate a crosstalk-compensating voltage.

Figure 7:
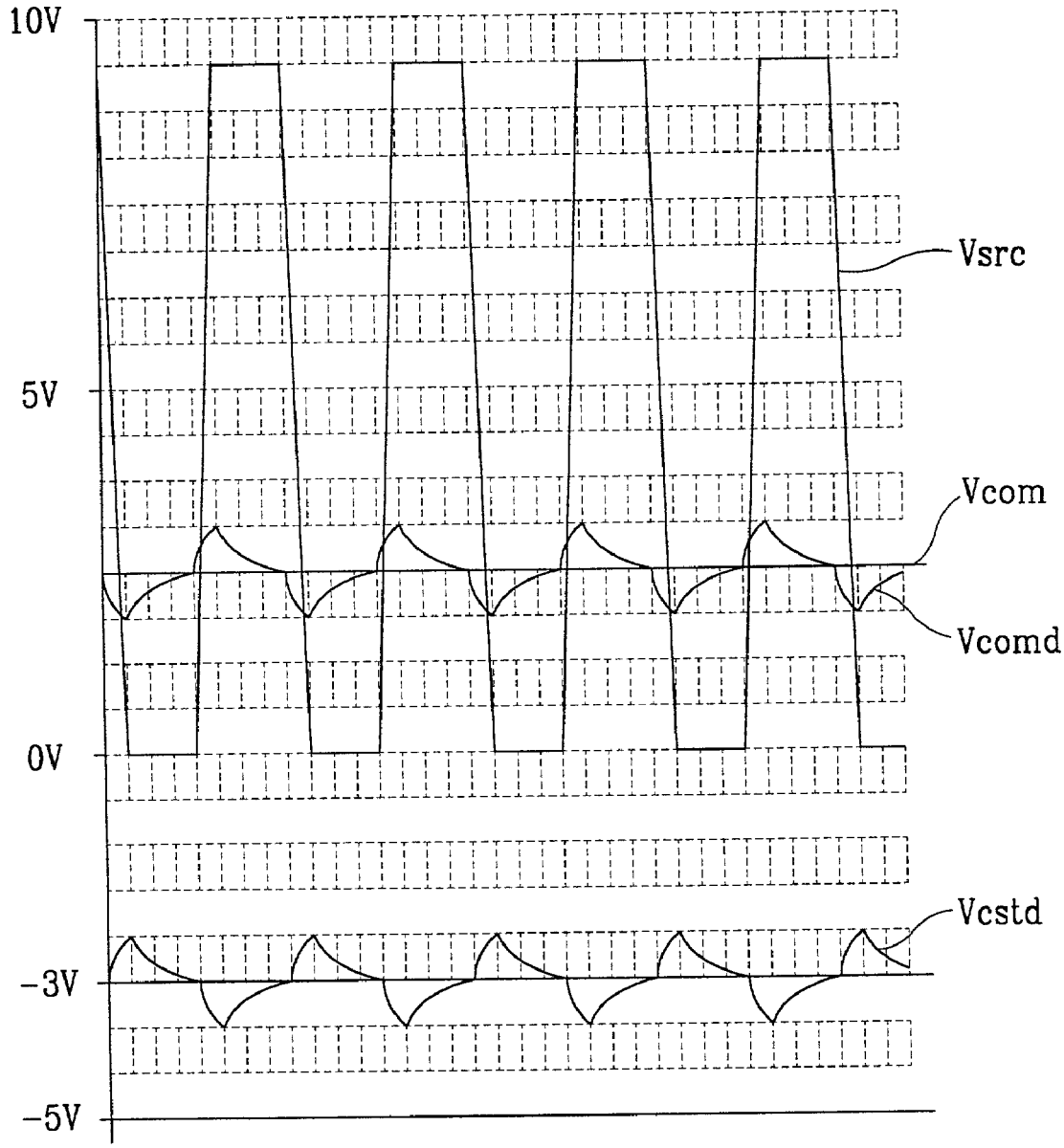
FIG. 7 is a waveform diagram for the results of the simulation of the circuit shown in FIG. 6B.

FIG. 7 is a waveform diagram showing simulation results of the circuit of FIG. 6B in a case wherein the first resistor $R_1$ is equal to the second resistor $R_2$. That is, the capacitance of the liquid crystal capacitor $C_{LC}$ (in FIG. 4) is assumed to be equal to that of the storage capacitor $C_{st}$ (in FIG. 4).

Referring to FIGS. 6B and 7, the common electrode voltage $V_{com}$ coupled to the waveform of the data voltage $V_{src}$ applied to the data line (in FIG. 4) is distorted, and there occurs a waveform of the offset voltage $V_{cstd}$ that is in antiphase with respect to the AC component of the common electrode distortion voltage $V_{comd}$, the offset voltage $V_{cstd}$ is applied to the storage capacitor $C_{st}$.

If the capacitance of the liquid crystal capacitor $C_{LC}$ is set to be different from that of the storage capacitor $C_{st}$, an optimum compensating waveform can be formed by setting the ratio of the first resistor $R_1$ to the second resistor $R_2$ as the capacitance ratio of the liquid crystal capacitor $C_{LC}$ to the storage capacitor $C_{st}$.

As described above, the present invention enables a constant charging rate of the pixel voltage even with a different distortion level of the common electrode voltage applied to the liquid crystal capacitor. In particular, the present invention overcharges the storage capacitor to compensate for a deficient rate of charge of the liquid crystal capacitor caused by a distortion of the common electrode voltage. Preferably, the charging rate difference between the liquid crystal capacitor and the storage capacitor compensates for the lack of the charging rate of the liquid crystal capacitor in the pixel. Accordingly, a constant rate of charge of the pixel voltage can be maintained despite variations in distortion level of the common electrode voltage, to thereby preventing crosstalk.

While this invention has been described in connection with what is presently considered to be the most practical and preferred embodiment, it is to be understood that the invention is not limited to the disclosed embodiments, but is intended to cover modifications and equivalent arrangements within the spirit and scope of the appended claims.

What is claimed is:

1. A liquid crystal display, comprising:

a data driver for outputting an image signal;

a gate driver for sequentially outputting a scanning signal;

a liquid crystal display panel including a plurality of pixels for displaying an image, the plurality of pixel having a switching element for controlling the image signal in response to the scanning signal, a liquid crystal capacitor driven by a voltage difference between the image signal received at one terminal thereof and a common electrode voltage received at another terminal thereof, and a storage capacitor for accumulating the charge of image signal received at the one terminal thereof when the switching element is turned on, and applying the accumulated image signal to the liquid crystal capacitor via the one terminal thereof when the switching element is turned off;

a distortion detector for detecting the common electrode voltage applied to the other terminal of the liquid crystal capacitor and outputting a common electrode distortion voltage; and an offset voltage generator for outputting an offset voltage to change a rate of charge of the storage capacitor based on the common electrode distortion voltage, wherein the offset voltage generator comprises:

an OP amplifier for receiving the common electrode voltage at a non-inverting terminal thereof and the common electrode distortion voltage at an inverting terminal thereof, and outputting an output voltage at an output terminal thereof to a DC component remover; and a DC component remover for removing a DC component of the output voltage and outputting an AC offset voltage.

2. The liquid crystal display as claimed in claim 1, wherein the distortion detector includes a detection resistor for detecting the common electrode voltage and outputting the common electrode distortion voltage.

3. The liquid crystal display as claimed in claim 2, wherein the distortion detector detects a potential difference between both terminals of the detection resistor.

4. The liquid crystal display as claimed in claim 1, wherein the distortion detector detects a potential difference between both terminals of an internal resistor of the liquid crystal panel applied to the common electrode voltage and outputs the common electrode distortion voltage.

5. The liquid crystal display as claimed in claim 1, wherein the offset voltage generator receives the common electrode voltage at a non-inverting terminal thereof and the common electrode distortion voltage at an inverting terminal thereof, and outputs the offset voltage at an output terminal thereof.

6. The liquid crystal display as claimed in claim 1, wherein the offset voltage is in antiphase with respect to the common electrode distortion voltage.

7. The liquid crystal display as claimed in claim 1, wherein the offset voltage is generated at a capacitance ratio of the liquid crystal capacitor to the storage capacitor.

8. The liquid crystal display as claimed in claim 1, wherein the offset voltage generator for outputting the offset voltage increases a rate of charge of the storage capacitor based on the common electrode distortion voltage.

9. An apparatus for driving a liquid crystal display, which includes a liquid crystal display panel that has a switching element formed in an area adjacent a gate line and a data line and is connected to the gate line and the data line, a liquid crystal capacitor for providing current to the switching element for controlling an image signal based on a pixel voltage in proportion to a common electrode voltage and a voltage potential of the data line, and a storage capacitor for accumulating the data voltage when the switching element is turned on, and applying the accumulated data voltage to the liquid crystal capacitor when the switching element is turned off, the apparatus comprising:

a distortion detector for detecting a distortion of the common electrode voltage applied to the liquid crystal capacitor and outputting a common electrode distortion voltage to the offset voltage generator; and an offset voltage generator for increasing a rate of charge of the storage capacitor based on the common electrode distortion voltage and outputting an offset voltage for overcharging the storage capacitor, wherein the offset voltage generator comprises:

an OP amplifier for receiving the common electrode voltage at a non-inverting terminal thereof and the common electrode distortion voltage at an inverting terminal thereof, and outputting an output voltage at an output terminal thereof to a DC component remover; and a DC component remover for removing a DC component of the output voltage and outputting an AC offset voltage.

10. The apparatus as claimed in claim 9, wherein the distortion detector includes a detection resistor for detecting the common electrode voltage and outputting the common electrode distortion voltage.

11. The apparatus as claimed in claim 9, wherein the distortion detector includes a detection resistor in the liquid crystal display panel.

12. The apparatus as claimed in claim 9, wherein the offset voltage generator receives the common electrode voltage at a non-inverting terminal thereof and the common electrode distortion voltage at an inverting terminal thereof, and outputs the offset voltage at an output terminal thereof.

13. The apparatus as claimed in claim 9, wherein the offset voltage is in antiphase with respect to the common electrode distortion voltage.

* * * * *